US007190361B2

(12) United States Patent
Igarashi et al.

(10) Patent No.: US 7,190,361 B2
(45) Date of Patent: Mar. 13, 2007

(54) IMAGE DISPLAY DEVICE

(75) Inventors: Youichi Igarashi, Mobara (JP); Yoshio Oowaki, Mobara (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 477 days.

(21) Appl. No.: 10/150,936

(22) Filed: May 21, 2002

(65) Prior Publication Data

US 2003/0011547 A1 Jan. 16, 2003

(30) Foreign Application Priority Data

Jul. 10, 2001 (JP) ..... 2001-209256

(51) Int. Cl.
*G09G 5/00* (2006.01)

(52) U.S. Cl. ..... 345/213; 345/211

(58) Field of Classification Search ..... 345/204–215, 345/76–102; 713/300–400
See application file for complete search history.

(56) References Cited

U.S. PATENT DOCUMENTS 5,130,674 A * 7/1992 Pham et al. ..... 331/109
5,315,695 A * 5/1994 Saito et al. ..... 345/102
5,390,293 A 2/1995 Nishioka et al.
5,493,685 A * 2/1996 Zenda ..... 713/340
5,675,809 A * 10/1997 Gantt ..... 713/300
6,211,744 B1 * 4/2001 Shin ..... 331/57
6,229,513 B1 5/2001 Nakano et al.
6,339,422 B1 1/2002 Kuwajima et al.
6,720,943 B1 * 4/2004 Kim et al. ..... 345/87

FOREIGN PATENT DOCUMENTS

JP 03-225949 10/1991
JP 07336218 A * 12/1995
JP 2000/172233 6/2000

* cited by examiner

*Primary Examiner*—Alexander Eisen
(74) *Attorney, Agent, or Firm*—Antonelli, Terry, Stout and Kraus, LLP.

(57) ABSTRACT

Even in a liquid crystal display device that has been completed as a product, EMI countermeasures and power saving can be realized according to the use environment of an electronic apparatus in which the liquid crystal display device is to be mounted. A timing converter mounted on an interface printed circuit board of the liquid crystal display device is provided with a display mode selecting terminal. A display mode selecting signal which varies the frequency of a pixel clock signal for an image signal is applied to the display mode selecting terminal from the outside, thereby varying the frequency of the pixel clock signal.

4 Claims, 6 Drawing Sheets

IMAGE DISPLAY DEVICE

BACKGROUND OF THE INVENTION

The present invention relates to an image display device.

In one example of an image display device, driver circuits, which include data-line driver circuits and scanning-line driver circuits are mounted at the periphery of a liquid crystal panel, which constitutes an image display screen; and, an interface printed circuit board, which supplies various signals for display to those driver circuits, is also secured at the periphery of the liquid crystal panel. The interface printed circuit board has mounted thereon a display control device operating as a timing converter and a power supply circuit. The timing converter generates display data for displaying an image on the liquid crystal panel in response to an image signal (display signal), that is, various timing signals, including pixel clock signals received from an external signal source, and a power supply voltage. Semiconductor integrated circuits constitute the power supply circuit.

SUMMARY OF THE INVENTION

In an image display device of the type disclosed above, the resolution of which is becoming increasingly higher, means for restraining electromagnetic radiation interference with the environment, so-called EMI countermeasures, are being adopted. EMI countermeasures are chiefly taken by establishing certain parameters, such as the structure of the housing of the liquid crystal display device, the electromagnetic shielding structures of data-line supply lines and the frequency of pixel clock signal being used. However, during product shipment, it may become necessary to take further EMI countermeasures for a liquid crystal display device that is subjected to EMI countermeasures, on the assumption that it is mounted in a notebook personal computer, when the liquid crystal display device is to be again mounted in another electronic apparatus, or according to the environment of use of the liquid crystal display device. In such a case, it is not realistic to alter the parameters of the liquid crystal display device, because a design change of the liquid crystal display device itself is needed.

There is a great demand for achieving a larger power saving in this kind of image display device. However, added power saving is difficult to achieve after the liquid crystal display device has been completed as a product. These facts have heretofore represented problems to be solved.

Therefore, it is an object of the invention to solve the foregoing problems by providing an image display device which incorporates the above-described EMI countermeasures and power saving even in a liquid crystal display device which exists as a finished product, according to the environment of use of an electronic apparatus in which the liquid crystal display device is to be mounted.

To achieve this object, the invention provides a construction in which a timing converter, that is mounted on an interface printed circuit board of a liquid crystal display device, is provided with a special terminal, and a signal which varies the frequency of a pixel clock signal for use in producing an image signal is applied to the special terminal from the outside. In addition, the invention provides a construction having a circuit capable of externally varying a power supply voltage to be supplied from the timing converter to driver circuits of the liquid crystal panel. Representative constructions and features afforded thereby, in accordance with the invention, will be described below.

(1) A liquid crystal display device includes data-line driver circuits and scanning-line driver circuits mounted at the periphery of a liquid crystal panel, and an interface printed circuit board provided in the vicinity of the liquid crystal panel. The interface printed circuit board is provided with a display control device which includes a timing converter and a plurality of semiconductor integrated circuits. The timing converter receives a display signal from an external signal source, various timing signals including pixel clock signals, and a power supply voltage, and it generates display data for displaying an image on the liquid crystal panel. The semiconductor integrated circuits constitute the power supply circuit. A semiconductor integrated circuit, which constitutes the timing converter, has a display mode selecting terminal for switching the frequency of a pixel clock, use in producing for an image to be displayed on the liquid crystal panel, between a high speed and a low speed. The semiconductor integrated circuit varies the frequency of the pixel clock signal for use in producing the image to be displayed on the liquid crystal panel, according to a display mode selecting signal that is applied to the display mode selecting terminal from the outside.

In the above-described construction, the display mode selecting terminal also may be connected to a fixed potential, which is provided on the interface printed circuit board and which corresponds to the display mode selecting signal. According to this construction, EMI countermeasures according to the use environment of an electronic apparatus in which the liquid crystal display device is to be mounted can be set during the mounting of the liquid crystal display device into the electronic apparatus.

(2) A liquid crystal display device, includes data-line driver circuits and scanning-line driver circuits mounted at the periphery of a liquid crystal panel, and an interface printed circuit board is also provided in the vicinity of the liquid crystal panel. The interface printed circuit board is provided with a timing converter and a plurality of semiconductor integrated circuits. The timing converter receives a display signal from an external signal source, various timing signals including pixel clock signals, and a power supply voltage, and it generates display data for displaying an image on the liquid crystal panel. The semiconductor integrated circuits constitute a power supply unit. A display control device is provided which has an operating-voltage adjusting circuit that externally adjusts the operating voltage for the data-line driving circuits of the liquid crystal panel, and the operating voltage for the liquid crystal panel is varied according to an operating-voltage adjusting signal applied to the operating-voltage adjusting circuit from the outside.

The operating-voltage adjusting signal applied to the operating-voltage adjusting circuit from the outside can be derived from a fixed potential source which is provided on the interface printed circuit board and corresponds to either level of the operating voltage of the liquid crystal panel. According to this construction, the power saving of the liquid crystal display device can be realized after the liquid crystal display device has been mounted in an electronic apparatus, and EMI countermeasures can be taken by decreasing the operating voltage of each of the data-line driver circuits. Incidentally, the invention is not limited to either of the above-described constructions or to any of the constructions of the embodiments which will be described later, and it goes without saying that various modifications can be made without departing from the technical idea of the invention.

Therefore, the invention can be applied to any of the following constructions.

(3) An image display device includes at least a plurality of data lines, a plurality of gate lines, data-line driver circuits electrically connected to the data lines, scanning-line driver circuits electrically connected to the gate lines, an interface printed circuit board, and a controller provided on the interface printed circuit board The controller has a display mode selecting terminal and is capable of varying the frequency of a clock signal to be supplied from the controller to the data-line driver circuits, according to a voltage applied to the display mode selecting terminal. Even with this construction, it is possible to take EMI countermeasures.

(4) In the construction (3), the voltage applied to the display mode selecting terminal is supplied from outside the image display device. With this construction, external control is enabled.

(5) In the construction (3), the voltage applied to the display mode selecting terminal is provided by either potential on the interface printed circuit board. With this construction, presetting is enabled, whereby it is possible to cope with the demand of each customer.

(6) In the construction (3), the clock frequency has a high-speed state and a low-speed state.

(7) In the construction (6), there is also a memory area in which display data is temporarily stored when the clock frequency is in the low-speed state. With this construction, the difference between clocks can be absorbed, whereby the effect of EMI reduction can be obtained.

(8) In the construction (3), the frequency of the clock signal to be supplied to the data-line driver circuits is lower than the frequency of the clock signal to be applied to the image display device from outside the image display device. With this construction, an external standardized normal signal is used, and the frequency of an internal signal is decreased, whereby it is possible to strengthen the EMI countermeasures to a further extent.

(9) In the construction (5), the potential on the interface printed circuit board is either a ground potential or an operating potential. By using the ground potential or the operating potential to set the potential, it is possible to set a stable potential that is resistant to noise, and it is possible to prevent unintended switching between display modes due to external noise, whereby an image display device that is resistant to noise can be obtained.

(10) An image display device includes at least a plurality of data lines, a plurality of gate lines, data-line driver circuits electrically connected to the data lines, scanning-line driver circuits electrically connected to the gate lines, an interface printed circuit board, and an operating-voltage adjusting circuit provided on the interface printed circuit board. The operating-voltage adjusting circuit has an operating-voltage adjusting terminal that is capable of controlling the operating-voltage adjusting circuit, and the operating-voltage adjusting circuit is capable of varying the voltage to be supplied at least to either the data-line driver circuits or the scanning-line driver circuits, according to a voltage applied to the operating-voltage adjusting terminal. With this construction, power saving in the image display device can be achieved.

(11) In the construction (10), the voltage applied to the operating-voltage adjusting terminal is supplied from outside the image display device. With this construction, an electric-power mode can be set from the outside.

(12) In the construction (10), the voltage applied to the operating-voltage adjusting terminal is given by either potential on the interface printed circuit board. With this construction, the image quality and power consumption can be set according to the demand of each customer.

(13) In the construction (10), the operating-voltage adjusting circuit is capable of varying a resistance value according to the voltage applied to the operating-voltage adjusting terminal. With this construction, the operating voltage can be varied with a resistor, which is an inexpensive element, or by the use of an integrated circuit.

(14) In the construction (13), the operating-voltage adjusting circuit varies the resistance value with the use of an analog switch.

(15) In the construction (14), the operating-voltage adjusting circuit has a plurality of resistors capable of switching the state of connection of the resistors between a series state and a parallel state. With this construction, the resistance value can be greatly varied with a simple construction.

(16) In the construction (12), the potential on the interface printed circuit board is either a ground potential or an operating potential. By using the ground potential or the operating potential to set the potential. it is possible to set a stable potential that is resistant to noise, and it is possible to prevent unintended switching between display modes due to external noise, whereby an image display device that is resistant to noise can be obtained.

(17) In the construction (10), the voltage to be supplied to at least either the data-line driver circuits or the scanning-line driver circuits is higher when a voltage from an external power source is supplied than when an internal power source is used. With this construction, during driving using the external power source whose power consumption is not required to be greatly reduced, the voltage can be increased so as to enhance the image quality; whereas, during driving using the internal power source, whose power consumption is directly linked to the operating time, the voltage can be decreased to reduce the power consumption.

An image display device includes at least a plurality of data lines, a plurality of gate lines, data-line driver circuits electrically connected to the data lines, and scanning-line driver circuits electrically connected to the gate lines. The image display device is capable of coping with driving using supply of a voltage from an external power source and driving using an internal power source. With this construction, during driving using the external power source, whose power consumption is not required to be greatly reduced, the voltage can be increased so as to enhance the image quality; whereas, during driving using the internal power source, whose power consumption is directly linked to the operating time, the voltage can be decreased to reduce the power consumption.

(19) In the construction (18) the image display device is a notebook personal computer. This construction can provide a great advantage when used in the notebook personal computer.

(20) An image display device includes at least a plurality of data lines, a plurality of gate lines, data-line driver circuits electrically connected to the data lines, scanning-line driver circuits electrically connected to the gate lines, an interface printed circuit board, and a controller and an operating-voltage adjusting circuit which are provided on the interface printed circuit board. The controller has a display mode selecting terminal, whereby the controller is capable of varying the frequency of the clock signal to be supplied from the controller to the data-line driver circuits, according to a voltage applied to the display mode selecting terminal. The operating-voltage adjusting circuit has an operating-voltage adjusting terminal that is capable of controlling the operating-voltage adjusting circuit, and the operating-voltage adjusting circuit is capable of varying the voltage to be supplied to at least either the data-line driver circuits or the scanning-line driver circuits, according to a voltage applied to the operating-voltage adjusting terminal. With this construction, it is possible to provide a far greater effect of EMI reduction and a far greater reduction of the power consumption. This is because a decrease in the clock frequency also contributes to a lowering of the power consumption, and a reduction in the voltage also contributes to a reduction in EMI.

(21) In the construction (20), the voltage to be supplied to at least either the data-line driver circuits or the scanning-line driver circuits is high when the clock frequency is high. With this construction, the image quality during high-quality image display can be further improved, and the power consumption during low power consumption can be further decreased.

(22) In the construction (20), a voltage is supplied from the controller to the operating-voltage adjusting terminal, this voltage differing according to the voltage applied to the display mode selecting terminal. With this construction, the clock frequency and the voltage can be simultaneously controlled on the basis of one external or internal signal.

Further aspects of the invention will become apparent from the following description provided in this specification and the accompanying drawings.

BRIEF DESCRIPTION OF THE DRAWINGS

The invention will become more readily appreciated and understood from the following detailed description of preferred embodiments of the invention, when taken in conjunction with the accompanying drawings, in which.

DETAILED DESCRIPTION OF THE INVENTION

Preferred embodiments of the invention will be described below in detail with reference to the accompanying drawings.

Figure 1:
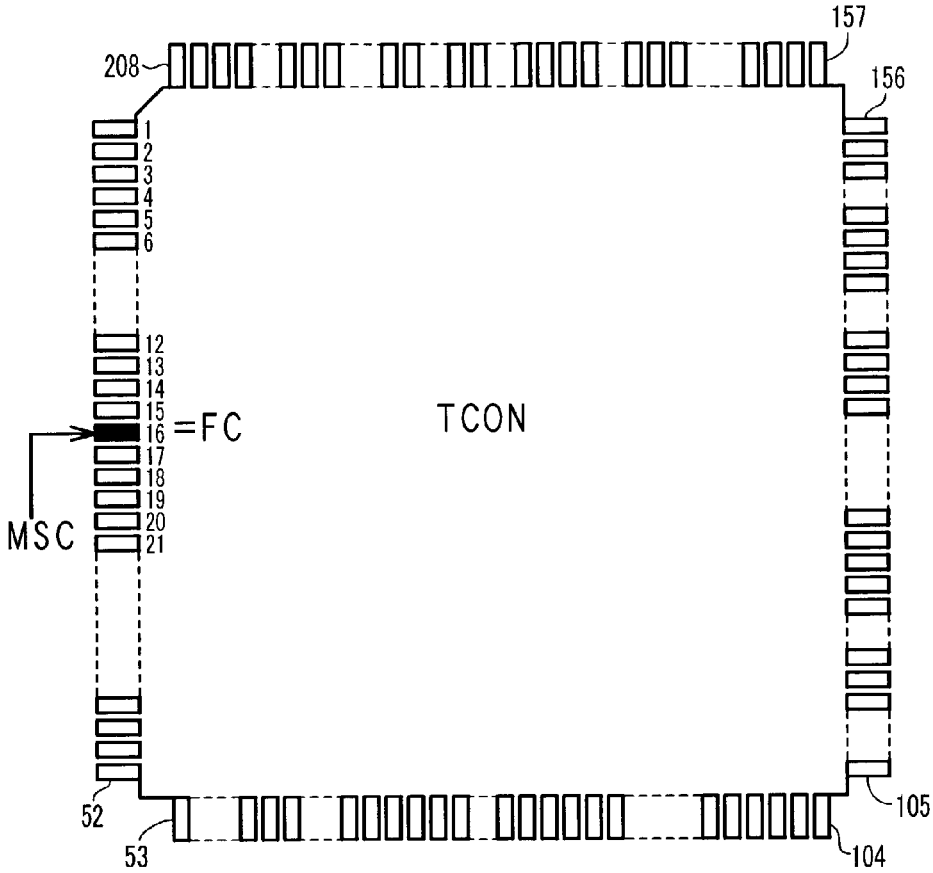
FIG. 1 is a diagram of a timing converter, for use in a first embodiment of a liquid crystal display device according to the invention.

FIG. 1 is a diagrammatic view of a timing converter, for use in a first embodiment of a liquid crystal display device according to the invention. This timing converter is mounted on an interface printed circuit board, which is provided in the vicinity of a liquid crystal panel. FIG. 1 shows only the arrangement of terminals of a timing converter TCON. The number of the terminals (pins) of the timing converter TCON in the illustrated example is 208.

The timing converter TCON has power source (3.3 V) terminals, grounding terminals, input terminals and output terminals, to each of which there is assigned any one of the terminal numbers 1 through 208. A display mode selecting terminal FC is provided among those terminals. In this first embodiment, terminal number 16 is assigned to the display mode selecting terminal FC. When a display mode selecting signal MSC, which selects between a high speed and a low speed frequency of a pixel clock for an image signal to be displayed on the liquid crystal panel, the timing converter TCON switches the image signal between a high-speed frequency and a low-speed frequency.

In the first embodiment, the timing converter TCON is set so that, when the display mode selecting signal MSC goes to "0", the pixel clock frequency becomes a high speed clock of 162 MHz; whereas, when the display mode selecting signal MSC goes to "1", the pixel clock frequency becomes a low speed clock of 135 MHz. Incidentally, when the display mode selecting terminal FC is in its grounded state, the display mode selecting signal MSC is at "0"; whereas, when a power source voltage (3.3 V) is provided at the display mode selecting terminal FC, the display mode selecting signal MSC is at "1". The setting of the display mode selecting signal MSC to "0" or "1" can be realized by selectively connecting the display mode selecting signal terminal to ground-potential wiring or to operating-voltage wiring which lies on the interface printed circuit board.

Figure 2:
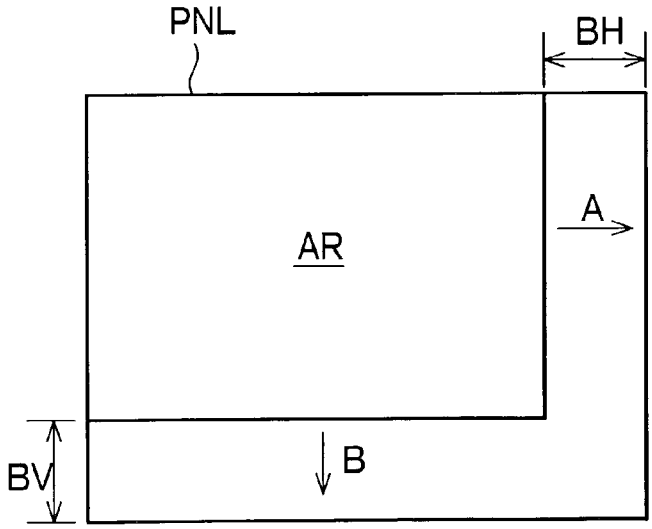
FIG. 2 is a diagram of the different states of display to be provided on a liquid crystal panel according to a display mode selecting signal in the first embodiment.

FIG. 2 is a diagram showing the state of the display to be provided on the liquid crystal panel according to the display mode selecting signal MSC in the first embodiment. In FIG. 2, it is assumed that, when the pixel clock signal is at 162 MHz for a high-speed display mode, an area AR occupies the entire screen of the liquid crystal panel PNL. In FIG. 2, a horizontal blanking signal is diagrammatically shown at BH, and a vertical blanking signal is diagrammatically shown at BV. When the display mode selecting signal MSC is set to "1", the timing converter TCON reduces the period of the horizontal blanking signal BH and the period of the vertical blanking signal BV in the directions of arrows A and B, respectively.

Accordingly, the timing at which each pixel signal of an image signal is supplied to a corresponding one of the pixels of the liquid crystal panel PNL is delayed on the screen by the periods of the horizontal blanking signal BH and the vertical blanking signal BV, whereby the horizontal size and, the vertical size of an image to be displayed, on the screen of the liquid crystal panel PNL is enlarged.

In this manner, according to the first embodiment, a normal display can be provided with respect to both high- and low-speed pixel clock signals, according to the display mode selecting signal MSC to be applied from the outside, without the need to alter the parameters of the liquid crystal display device, and EMI countermeasures can be further improved by selecting a low-speed mode according to the environment.

Figure 3:
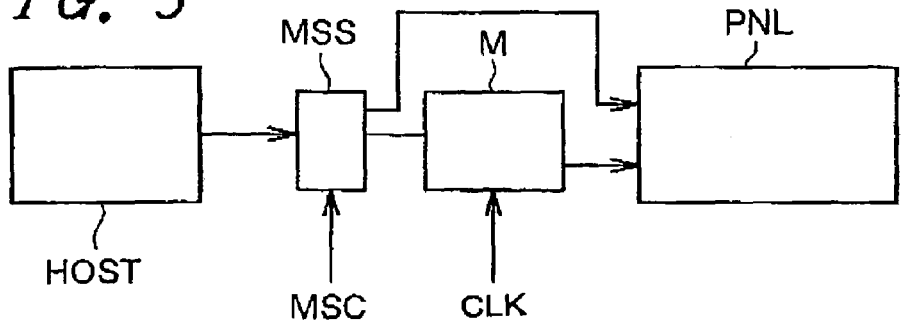
FIG. 3 is a block diagram of a display control device, for use in a second embodiment of the liquid crystal display device according to the invention.

FIG. 3 is a block diagram of a display control device, relating to a second embodiment of the liquid crystal display device according to the invention. In the second embodiment, in the case of a low-speed mode, a display signal, which is inputted from an external signal source HOST, is temporarily stored in a memory M, and the stored display signal is read out with a low-speed read-out clock signal and is supplied to the liquid crystal panel PNL. Incidentally, during the high-speed mode, the display signal from the external signal source HOST is supplied to the liquid crystal panel PNL without passing through the memory M.

More specifically, the display signal inputted from the external signal source HOST is switched between the high-speed mode and the low-speed mode in accordance with the display mode selecting signal MSC that is applied to a display mode selecting circuit MSS from the outside. In the case where the display mode selecting signal MSC is "0", the high-speed mode is selected and the display signal inputted from the external signal source HOST is directly supplied to the liquid crystal panel PNL. On the other hand, in the case where the display mode selecting signal MSC is "1", the low-speed mode is selected, and the display signal inputted from the external signal source HOST is temporarily written into the memory M. A clock signal for this writing has a high-speed frequency (for example, 162 MHz). The written display signal is read out with a read-out clock signal CLK of low speed (for example, 135 MHz).

The setting of the display mode selecting signal MSC to "0" or "1" can be realized by connecting the display mode selecting signal terminal to ground-potential wiring or to operating-voltage wiring which lies on the interface printed circuit board. According to the second embodiment, proper display of an image can be provided with respect to both high- and low-speed pixel clock signals, according to the display mode selecting signal MSC to be applied from the outside, without the need to alter the parameters of the liquid crystal display device, and EMI countermeasures can be further improved by selecting the low-speed mode according to the environment.

Figure 4:
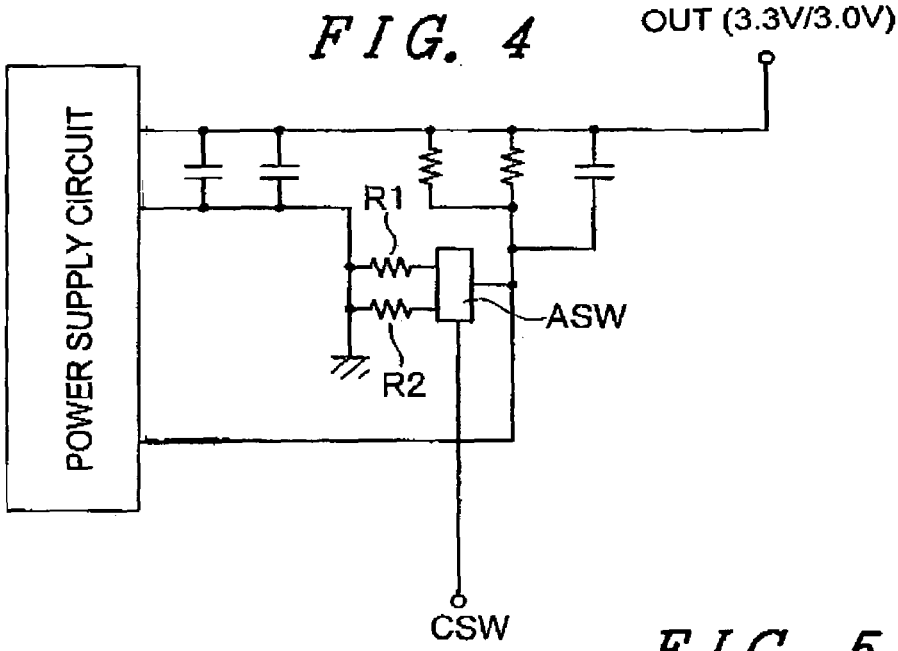
FIG. 4 is a schematic circuit diagram of a display control device, for use in a third embodiment of the liquid crystal display device according to the invention.

FIG. 4 is a schematic circuit diagram of the display control device, relating to a third embodiment of the liquid crystal display device according to the invention. In the third embodiment, EMI countermeasures are realized by decreasing the power source voltage to be supplied to the driver circuits of the liquid crystal panel~In the liquid crystal display device, it is assumed that an operating voltage for data line driver circuits (i.e., drain drivers) of the liquid crystal panel is 3.3 V. In the case where the environment of an electronic apparatus in which the liquid crystal display device is used requires further EMI countermeasures, the operating voltage is decreased to, for example, 3.0 V.

As shown in FIG. 4, an analog switch ASW, which is connected in series with a parallel circuit made up of resistors R1 and R2, is provided between the power source voltage and an output terminal OUT from which the operating voltage to the driver circuits is to be supplied. For example, the 3.3 V operating voltage is outputted to the driver circuits of the liquid crystal panel when the resistor R1 is selected by analog switch ASW, whereas the 3.0 V operating voltage is outputted when the resistor R2 is selected by analog switch ASW. A switching signal CSW, which is inputted from the outside, switches the analog switch ASW, thereby switching between the resistor R1 and the resistor R2.

According to the third embodiment, in the case where further EMI countermeasures are to be taken in the environment of the electronic apparatus in which the liquid crystal display device is used, the resistor R2 is selected. Since the operating voltage for the driver circuits is decreased, EMI is decreased, and, at the same time, the power consumption is also decreased. The analog switch ASW may be connected to a fixed potential in a work process during the mounting of the liquid crystal display device to the electronic apparatus, or it may also be mounted as a user setting switch on the interface printed circuit board. Otherwise, the analog switch ASW may also be set by software through the manipulation of a keyboard or the like.

Figure 5:
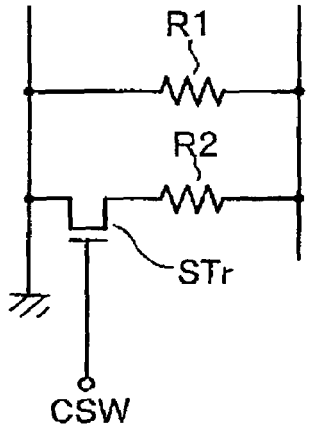
FIG. 5 is a schematic circuit diagram of a display control device, for use in a fourth embodiment of the liquid crystal display device according to the invention.

FIG. 5 is a schematic circuit diagram of a display control device, relating to a fourth embodiment of the liquid crystal display device according to the invention. The fourth embodiment is constructed in such a manner that the circuit shown in FIG. 5 is substituted for the section shown in FIG. 4 which includes the resistors R1 and R2 and the analog switch ASW. In the third embodiment, the two resistors R1 and R2 are selectively switched to vary the operating voltage for the driver circuits, but in the fourth embodiment, the two resistors R1 and R2 are switched between series connection and parallel connection.

More specifically, the 3.3V operating voltage is outputted to the driver circuits of the liquid crystal panel from the power supply circuit when only the resistor R1 is connected to ground, while the series circuit made up of the resistor R2 and a switching element STr is not connected with the resistor R1 because the switching element is non-conductive in the absence of the switching signal CSW. The switching signal CSW is inputted to a control terminal of the switching element STr from the outside. When the switching element STr is made conductive in response to the switching signal CSW, the resistor R1 and the resistor R2 are connected in parallel, so that the combined resistance of the resistors R1 and R2 lowers, causing the power supply circuit to output a 3.0 V operating voltage to the output terminal OUT. According to the fourth embodiment as well, in. the case where further EMI countermeasures are to be taken in the environment of the electronic apparatus in which the liquid crystal display device is used, the resistor R2 is selected. Since the operating voltage for the driver circuits is decreased, the EMI is decreased, and, at the same time, the power consumption is also decreased.

The switching signal CSW to be applied to the control terminal of the switching element STr may be directly obtained from appropriate potential wiring on the interface printed circuit board, or it may also be obtained from a user setting switch mounted on the interface printed circuit board. On the other hand, the switching signal CSW may also be set by software through the manipulation of a keyboard or the like.

Figure 6:
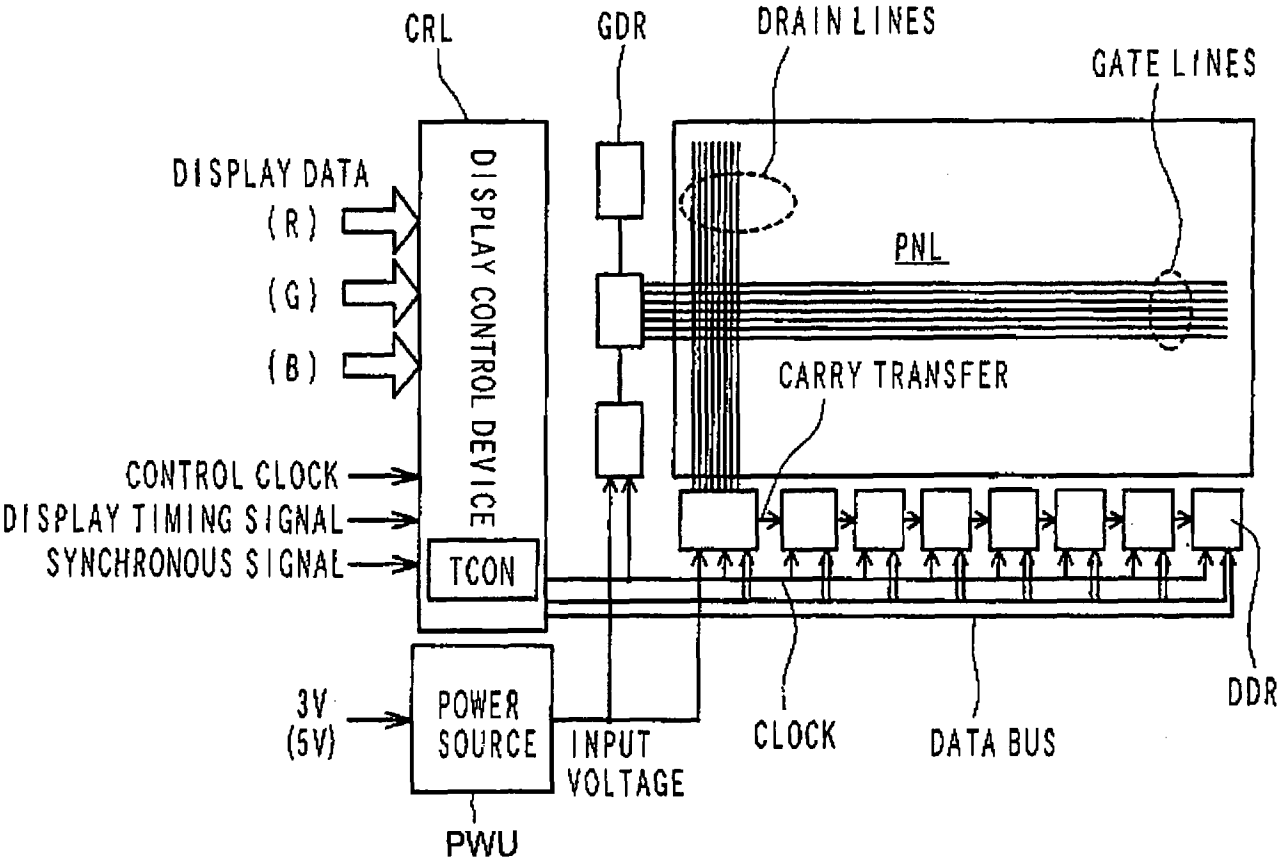
FIG. 6 is a schematic diagram of the construction of the liquid crystal panel and the drive system of a thin film transistor type liquid crystal display device to which the invention is applied.

An example of the overall construction of the liquid crystal display device according to the invention and an applied example thereof will be described below. FIG. 6 is a schematic diagram of the construction and the drive system of a thin film transistor type liquid crystal display device of the type to which the invention is applied. This liquid crystal display device has a printed circuit board on which are mounted driver circuits (semiconductor chips) for data lines (drain signal lines, drain lines or video signal lines), i.e., drain drivers DDR, and a printed circuit board on which are mounted driver circuits (semiconductor chips) for scanning lines (gate signal lines or gate lines). i.e., gate drivers GDR. The printed circuit boards are disposed at the periphery of the liquid crystal panel PNL.

The liquid crystal display device is also provided with an interface printed circuit board on which a display control device CRL and a power source circuit PWU are mounted. The display control device CRL is a display control unit for supplying display signals for image display (display data or image data), clock signals, grayscale voltages and the like to the drain drivers DDR and the gate drivers GDR. The circuit board (printed circuit board) is not shown. Incidentally, there is also a liquid crystal display device of the type in which the semiconductor chips are directly mounted on a glass substrate constituting the liquid crystal panel PNL instead of the printed circuit board provided with the data-line driver circuits and the printed circuit board provided with the scanning-line driver circuits.

In FIG. 6, various signals, such as display data, a control signal clock, a display timing signal and a synchronous signal, which are supplied from an external signal source (host), such as a computer, a personal computer or a TV receiver circuit, are inputted to the display control device CRL. The interface printed circuit board, which constitutes the display control device CRL, is provided with a grayscale reference voltage generating part, the timing converter TCON and the like, and it converts the display data supplied from the outside into data of the type which conforms to the format of the display to be generated on the liquid crystal panel PNL. The terminals of the timing converter TCON and its associated circuit are provided with the arrangement and construction of any of the above-described embodiments of the invention.

Display data and clock signals for the gate drivers GDR and the drain drivers DDR are supplied as shown in FIG. 6. A carry output from each of the drain drivers DDR is applied to the carry input of the next one on an unmodified basis. The interface printed circuit board or the timing converter TCON is provided with any of the constructions described above in connection with the embodiments of the invention.

Figure 7:
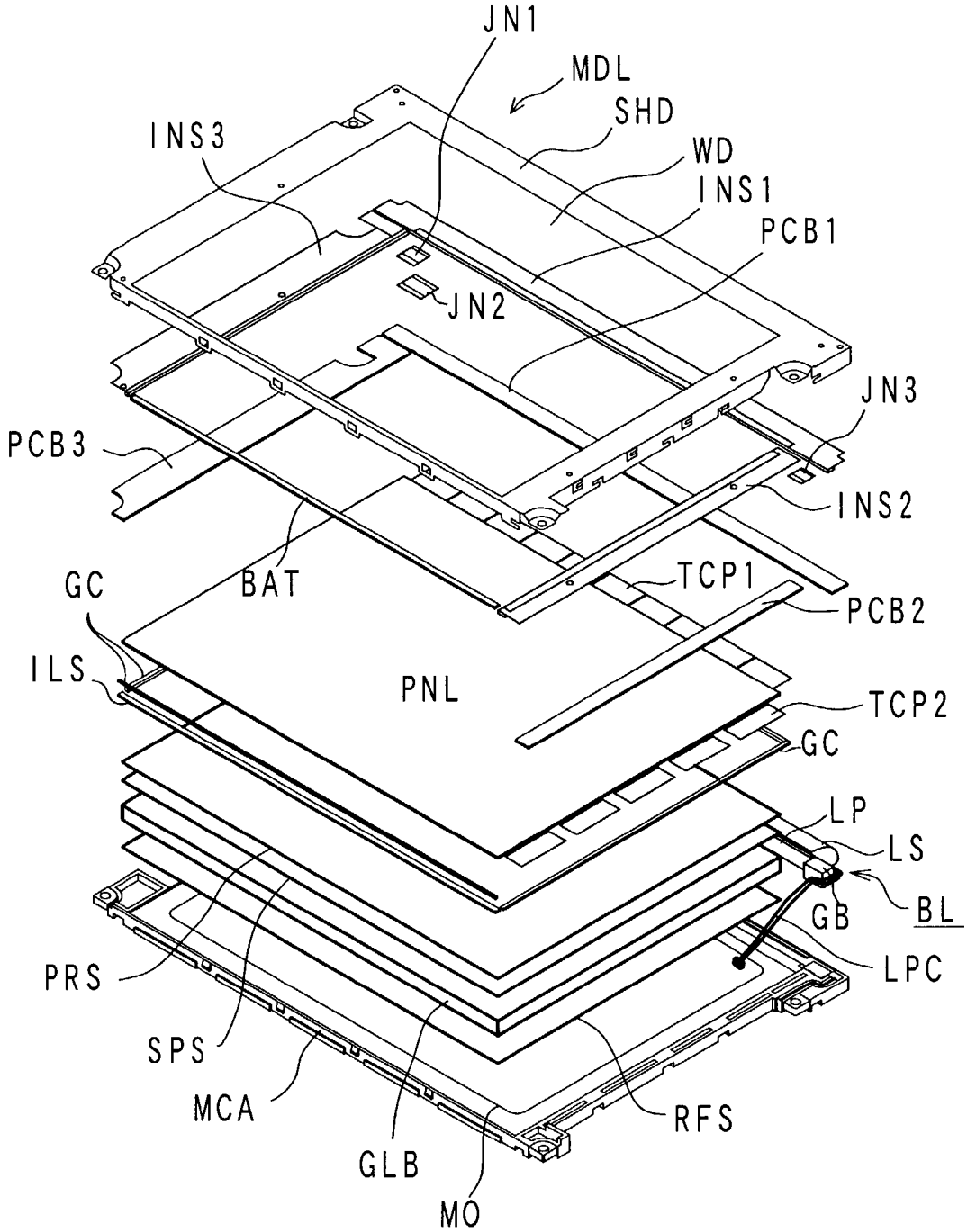
FIG. 7 is a developed perspective view of the overall construction of the liquid crystal display device according to the invention.

FIG. 7 is a developed perspective view showing the overall construction of the liquid crystal display device according to the invention. FIG. 7 illustrates a specific structure of the liquid crystal display device (hereinafter referred to as a liquid crystal display module MDL in which a liquid crystal panel formed of two substrates SUB1 and SUB2 that are stuck to each other, a driver unit, a backlight and other constituent members are integrated).

In FIG. 7, SHD denotes a shield case (also called a metal frame) made from a metal plate; WD denotes a display window; INS1 to INS3 denote insulating sheets; PCB1 to PCB3 denote circuit boards which constitute a driver unit (PCB1: a drain side circuit board, PCB2: a gate side circuit board, and PCB3: an interface circuit board); JN1 to JN3 denote joiners for electrically connecting the circuit boards PCB1 to PCB3; TCP1 and TCP2 denote tape carrier packages; PNL denotes a liquid crystal panel; GC denotes a rubber cushion; ILS denotes a light shield spacer; PRS denotes a prism sheet; SPS denotes a diffusing sheet; GLB denotes a light guide plate; RFS denotes a reflecting sheet; MCA denotes a lower case (a mold frame) formed by integral molding; MO denotes an aperture of the lower case MCA; LP denotes a fluorescent lamp; LPC denotes a lamp cable; GB denotes a rubber bush which supports the fluorescent lamp LP; BAT denotes a double-faced adhesive tape; and BL denotes a backlight formed of the fluorescent lamp LP, the light guide plate GLB and the like. The diffusing sheet members are stacked in the illustrated arrangement to assemble the liquid crystal display module MDL.

The liquid crystal display MDL has two kinds of accommodating/holding members, the lower frame MCA and the shield case SHD, and it is constructed by joining the shield case SHD and the lower case MCA together. The insulating sheets INS1 to INS3, the circuit boards PCB1 to PCB3 and the liquid crystal panel PNL are fixedly accommodated in the shield case SHD, and the backlight BL, which is made of the fluorescent lamp LP, the light guide plate GLB, the prism sheet PRS and the like, is accommodated in the lower case MCA.

Semiconductor integrated circuits (semiconductor chips) for driving the individual pixels of the liquid crystal panel PNL are mounted on the circuit boards PCB1 and PCB2, while semiconductor chips for receiving video signals from an external host and control signals, such as timing signals, as well as the timing converter TCON for processing timing and generating clock signals, are mounted on the interface circuit board PCB3. The mounting structure of the semiconductor chips on the timing converter TCON is as described above in connection with the embodiments of the invention.

The interface circuit board PCB3 and the circuit boards PCB1 and PCB2 are multilayer printed circuit boards, and a clock signal line is formed as an inner-layer line, in each of the interface circuit board PCB3 and the circuit boards PCB1 and PCB2. Incidentally, in FIG. 7, the drain side circuit board PCB1, the gate side circuit board PCB2 and the interface circuit board PCB3, all of which serve to drive thin film transistors TFT, are connected to the liquid crystal panel PNL by the tape carrier packages TCP1 and TCP2. The individual circuit boards are interconnected by the joiners JN1, JN2 and JN3.

However, the above-described construction is not limitative, and, in a liquid crystal display device which adopts a mounting scheme referred to as FCA or COG, in which driver circuits (semiconductor integrated circuits) are directly provided at the periphery of either substrate of a liquid crystal panel, flexible printed circuit boards are used in place of the circuit boards PCB1 and PCB2. In this case, the tape carrier packages TCP1 and TCP2 and the joiners JN1, JN2 and 3N3 are not particularly needed.

Figure 8:
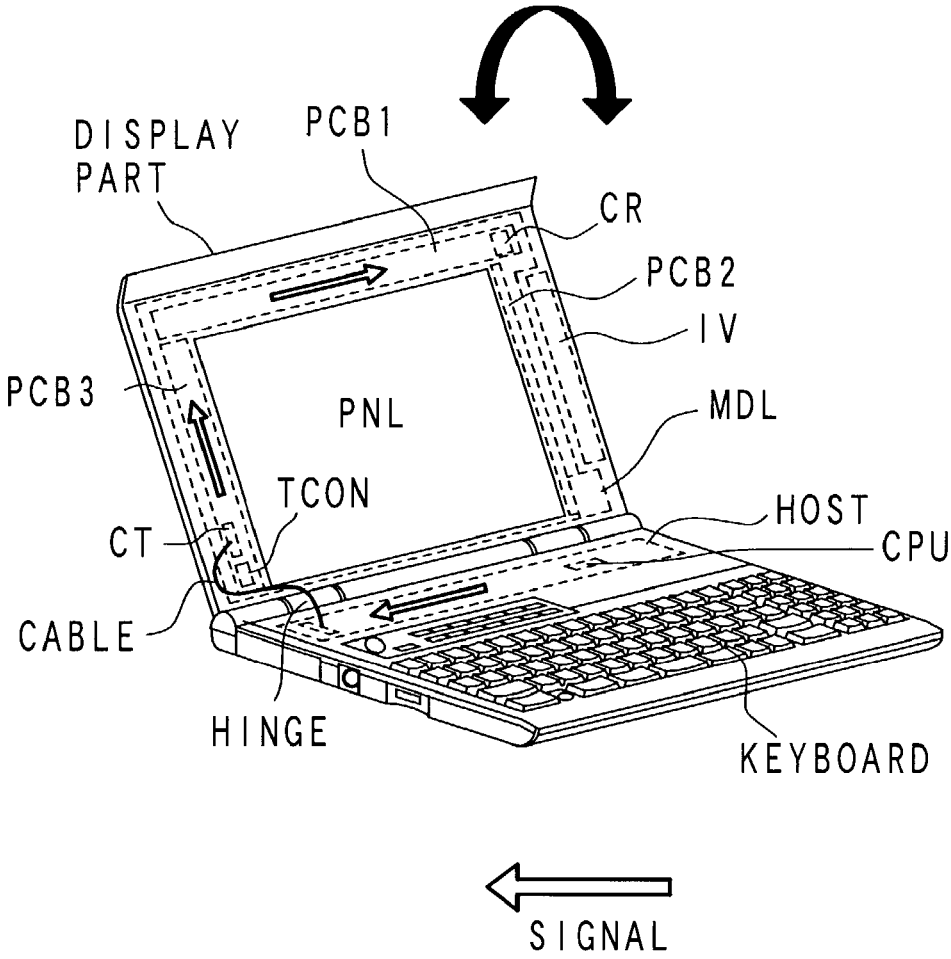
FIG. 8 is a perspective view of a notebook type computer, which represents one example of an electronic apparatus in which the liquid crystal display device according to the invention is mounted.

FIG. 8 is a perspective view of a notebook type computer representing one example of the electronic apparatus in which the liquid crystal display device according to the invention is mounted. This notebook type computer (portable personal computer) is comprised of a keyboard part (main-frame part) and a display part, which is joined to the keyboard part by hinges. The keyboard part accommodates signal generating functions such as provided by a keyboard, a host (host computer) and a CPU. The display part has the liquid crystal panel PNL, and the driver circuit boards PCB1 and PCB2, the driver circuit board PCB3 provided with the control chip TCON, and an inverter power source board, which is a backlight power source, are mounted at the periphery of the liquid crystal panel PNL.

The liquid crystal display module described above with reference to FIG. 7, which integrally includes the liquid crystal panel PNL, the various circuit boards PCB1, PCB2 and PCB3, the inverter power source board and the backlight, is mounted in the notebook type computer.

Figure 9:
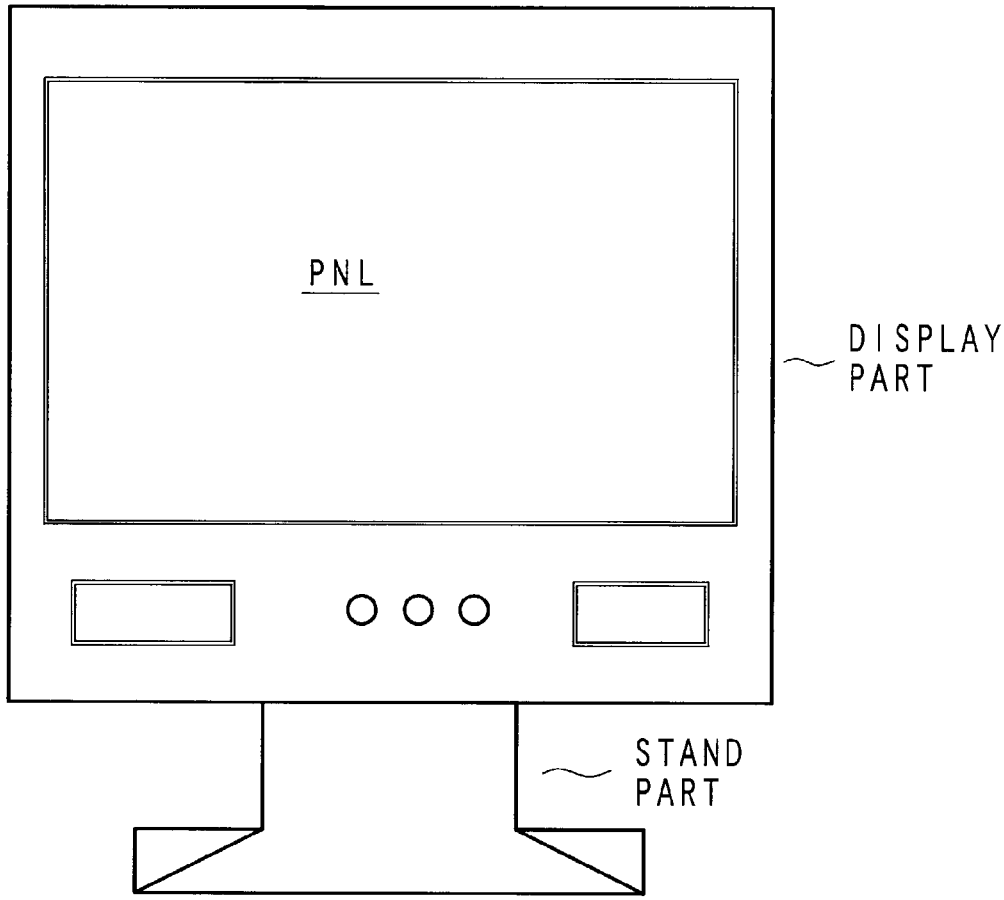
FIG. 9 is a diagrammatic front view of a display monitor, which represents another example of an electronic apparatus in which the liquid crystal display device according to the invention is mounted.

FIG. 9 is a front view of a display monitor which represents another example of the electronic apparatus in which the liquid crystal display device according to the invention is mounted. This display monitor is made of adisplay part and a stand part, and the liquid crystal display device according to the invention is mounted in the display part. Incidentally, a host computer or a television receiver circuit may be built in the stand part of this display monitor.

The advantages of the present invention can also be realized by the following construction.

The voltage to be supplied to at least either the data-line driver circuits or the scanning-line driver circuits may be made higher when a voltage from an external power source is supplied, than when an internal power source is used. In this case, during driving using an external power source, whose power consumption is not required to be greatly reduced, the voltage can be increased to enhance the image quality, whereas during driving using an internal power source, whose power consumption is directly linked to the period of the operating time, the voltage can be decreased to reduce the power consumption.

The invention may also be applied to a notebook type personal computer, such as that shown in FIG. 8, in the following manner.

In an image display device which includes at least a plurality of data lines, a plurality of gate lines, data-line driver circuits electrically connected to the data lines, and scanning-line driver circuits electrically connected to the gate lines, the image display device is capable of coping with driving using a voltage supplied from an external power source and driving using an internal power source, and a voltage to be supplied to at least either the data-line driver circuits or the scanning-line driver circuits may be made lower during the driving using the voltage supplied from the external power source, than during the driving using the internal power source.

Incidentally, since the above-described features can be fully understood without any special illustration, illustration thereof has been omitted. In this case, during driving using the external power source whose power consumption is not required to be greatly reduced, the voltage can be increased to enhance the image quality; whereas, during driving using the internal power source whose power consumption is directly linked to the period of the operating time, the voltage can be decreased to reduce the power consumption.

The notebook type personal computer is connected to an AC power source in normal use. In this case, since the notebook type personal computer is used equivalently to a desktop type personal computer, a higher image quality is more desirable. On the other hand, in the case where the notebook type personal computer is driven by the internal power source, for example, during outdoor use, the period of the driving time of the internal power source needs to be extended, and the power consumption needs to be decreased. In accordance with the invention, these demands are compatibly realized.

The ideal feature of the invention may also be realized in the following manner.

In an image display device which includes at least a plurality of data lines, a plurality of gate lines, data-line driver circuits electrically connected to the data lines, scanning-line driver circuits electrically connected to the gate lines, an interface printed circuit board and controller and an operating-voltage adjusting circuit provided on the interface printed circuit board, the controller having a display mode selecting terminal, the controller being capable of varying the clock frequency to be supplied from the controller to the data line driver circuits, according to a voltage applied to the display mode selecting terminal, the operating-voltage adjusting circuit has an operating-voltage adjusting terminal capable of controlling the operating-voltage adjusting circuit, and the operating-voltage adjusting circuit is capable of varying a voltage to be supplied to at least either the data-line driver circuits or the scanning-line driver circuits, according to a voltage applied to the operating-voltage adjusting terminal.

The above-described construction can be readily understood from the descriptions and the drawings of the other embodiments described previously in this specification. The above-described construction can serve a far greater effect of EMI reduction and a far greater effect of power consumption reduction. This is because a decrease in the clock frequency also contributes to a lowering of the power consumption and a reduction in the voltage also contributes to a reduction in EMI.

In the above-described construction, the voltage to be supplied to at least either the data-line driver circuits or the scanning-line driver circuits may be made high when the clock frequency is high. In this case, the image quality during high-quality image display can be further improved, and the power consumption during low power consumption can be further decreased.

The above-described construction may also adopt an arrangement in which a voltage is supplied from the controller to the operating-voltage adjusting terminal, and the voltage may be made different according to the voltage applied to the display mode selecting terminal. Since the clock frequency and the voltage can be simultaneously controlled on the basis of one external or internal signal, a simplification in structure and a simplification in control are realized.

As is apparent from the foregoing description, according to the invention, EMI countermeasures and power saving for a liquid crystal display device can be realized with an external display mode switching signal or an external operating-voltage varying signal, and the liquid crystal display device can be applied to different use environments, whereby it is possible to provide a liquid crystal display device which enables realization of EMI countermeasures and power saving even after having been completed as a product.

What is claimed is:

1. An image display device comprising:

a display panel having a plurality of data lines and a plurality of gate lines;

a plurality of data-line driver circuits electrically connected to said data lines;

a plurality of scanning-line driver circuits electrically connected to said gate lines;

a memory;

an interface printed circuit board; and a controller provided on said interface printed circuit board, said controller including a display mode selecting terminal;

said controller being capable of varying a clock frequency supplied to said data-line driver circuits from a high-speed state to a low-speed state in accordance with an external voltage applied to said display mode selecting terminal;

wherein, when said clock frequency is in the low-speed state, display data supplied to said controller from outside the image display device is temporarily stored in said memory, and subsequently transmitted to said display panel; and wherein, when said clock frequency is in the high-speed state, display data from outside the image display device is transmitted directly to said display panel.

2. An image display device according to claim 1, wherein the voltage applied to the display mode selecting terminal is derived from a potential on the interface printed circuit board.

3. An image display device according to claim 1, wherein the clock frequency to be supplied to the data-line driver circuits is lower than a clock frequency to be applied to the image display device from outside the image display device.

4. An image display device according to claim 2, wherein the potential on the interface printed circuit board is one of a ground potential and an operating potential.

* * * * *